US005180100A

United States Patent [19]

Shimizu

[11] Patent Number: 5,180,100

[45] Date of Patent: Jan. 19, 1993

[54] WRAPAROUND CARTON LOCK

[75] Inventor: Jamie A. Shimizu, Hackensack, N.J.

[73] Assignee: Oak Tree Packaging Corporation, Montvale, N.J.

[21] Appl. No.: 885,762

[22] Filed: May 20, 1992

[51] Int. Cl.[5] ..... B65D 5/42

[52] U.S. Cl. ..... 229/198.2; 229/40

[58] Field of Search ..... 229/40, 149, 198.2; 206/427

[56] References Cited

U.S. PATENT DOCUMENTS

| | | | |
|---|---|---|---|
| 2,951,583 | 9/1960 | Sanford | 229/149 |
| 3,375,968 | 4/1968 | Weiss | 229/40 |
| 3,384,291 | 5/1968 | Graser | 229/40 |
| 3,548,566 | 12/1970 | Sherman | 229/40 |
| 3,705,681 | 12/1972 | Rossi et al. | 229/40 |
| 4,526,316 | 7/1985 | Sutherland | 229/40 |
| 4,708,284 | 11/1987 | Sutherland et al. | 229/40 |

FOREIGN PATENT DOCUMENTS

| | | | |
|---|---|---|---|
| 1496410 | 9/1967 | France | 229/40 |
| 1329170 | 9/1973 | United Kingdom | 229/40 |

*Primary Examiner*—Gary E. Elkins
*Attorney, Agent, or Firm*—William H. Holt

[57] ABSTRACT

Lock arrangements for wraparound cartons of the type having primary and secondary locks, or latches, for holding the carton in tubular form for containing one or more beverage or food containers, or other articles or packages. A preferred secondary lock provides for easy insertion of locking tabs to facilitate locking of the panels.

2 Claims, 2 Drawing Sheets

FIG. 2
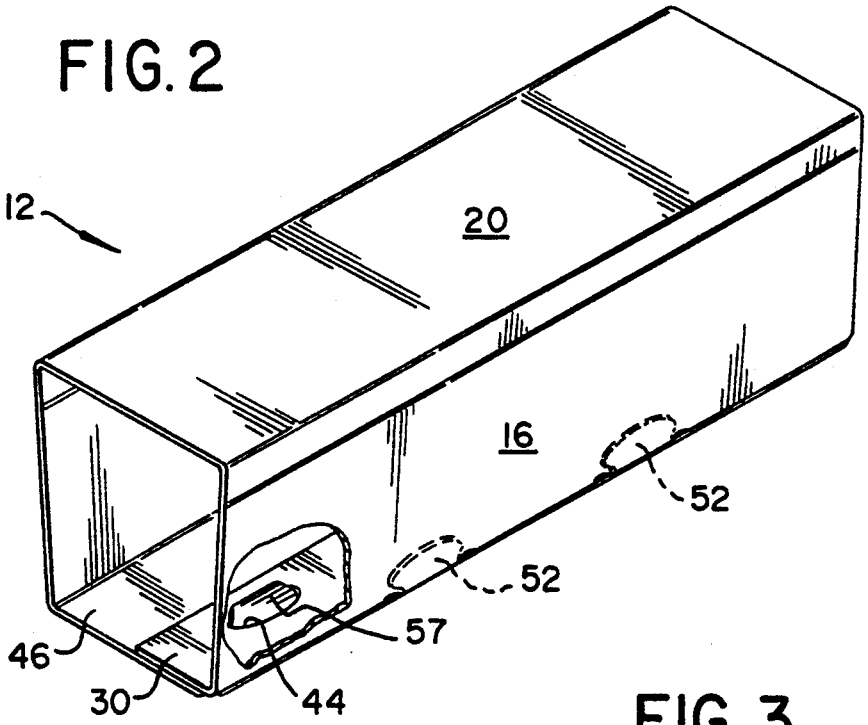
FIG. 3
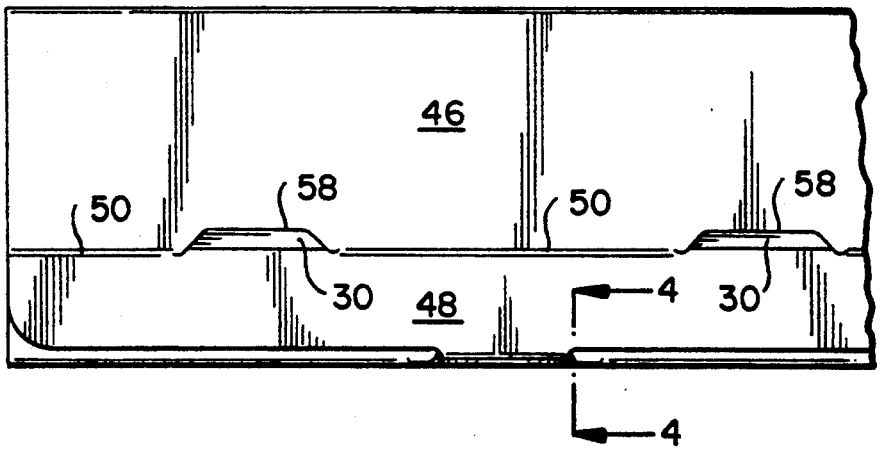
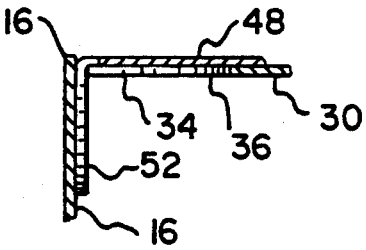
FIG. 4
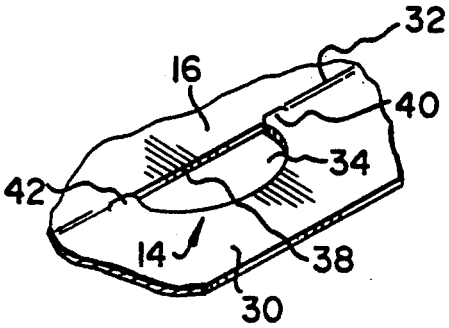
FIG. 5

WRAPAROUND CARTON LOCK

This invention relates to a novel carton of the type usually formed of paperboard, or the like, and including overlapping inner and outer closure panels which are provided with primary and secondary locks, or latches, comprised of apertures formed in or adjacent to the inner closure panel for receiving locking tabs formed as part of, or attached to, the outer closure panel.

More particularly, the present invention provides for novel primary and secondary locking arrangements for holding the carton in a generally tubular configuration.

BACKGROUND OF THE PRIOR ART

Cartons of the general type which include cooperative latching means, including primary and secondary locks, for maintaining wraparound blanks in the form of a tubular carton have been previously known. Such cartons, and blanks therefor, are exemplified by those disclosed in U.S. Pat. Nos. 3,655,117, granted on Apr. 11, 1972; 4,200,220, granted on Apr. 29, 1980; 4,526,316, granted on Jul. 2, 1985; and 4,708,284, granted on Nov. 24, 1987. These patents show a variety of primary and secondary locks which are described as being useful for securing articles within the resulting carton or package.

The prior art is also exemplified by U.S. Pat. No. 3,375,968, granted on Apr. 2, 1968. This patent discloses a plurality of containers which may be placed in side-by-side relation and are also shown in aligned double rows.

BRIEF SUMMARY OF THE INVENTION

An object of the invention is to provide a novel carton and secondary lock therefor wherein the carton has overlapping closure panels including an inner closure panel and an outer closure, a male locking member carried by and attached to the outer closure panel, the inner closure panel being connected to a second panel along a generally transversely extending fold line, a female locking member located along said fold line and including a cutout portion for receiving the male locking member, the cutout portion being located within the confines of the inner closure panel primarily on one side of the fold line and having a generally arcuate boundary having ends thereof joined by a rectilinear chord extending therebetween, and locking ear means located along the fold line adjacent the chord and the cutout portion for being engaged by the male locking member for retaining the male locking member within the cutout portion.

Another object of the invention is to provide a locking arrangement of the type described above wherein the cutout portion is generally semi-circular and provides a substantially large opening for receiving the male locking member therein.

A further object of the invention is to provide locking ears in the form of tab members which are cut from the second panel along curved lines and which extend from the inner closure panel across the fold line.

A still further object of the invention is to provide the inner closure with at least one centrally disposed opening for forming a portion of a primary lock means which is offset from the cutout portion.

With the above and other objects in view that will hereinafter appear, the nature of the invention will be more clearly understood by reference to the following detailed description, the appended claimed subject matter, and the several views illustrated in the accompanying drawings.

BRIEF DESCRIPTION OF THE DRAWINGS

FIG. 2 is a perspective view of a carton formed from the blank of FIG. 1 with a portion thereof broken away for clarity.

FIG. 3 is an enlarged, fragmentary of the underside of the carton illustrated in FIG. 2.

FIG. 4 is a fragmentary, sectional view, taken on line 4—4 of FIG. 3 and illustrates the preferred secondary lock means.

FIG. 5 is an enlarged, fragmentary view of a portion of adjacent carton panels and illustrates novel female locking member of the preferred secondary lock means of the present invention.

DETAILED DESCRIPTION OF THE INVENTION

Figure 1:
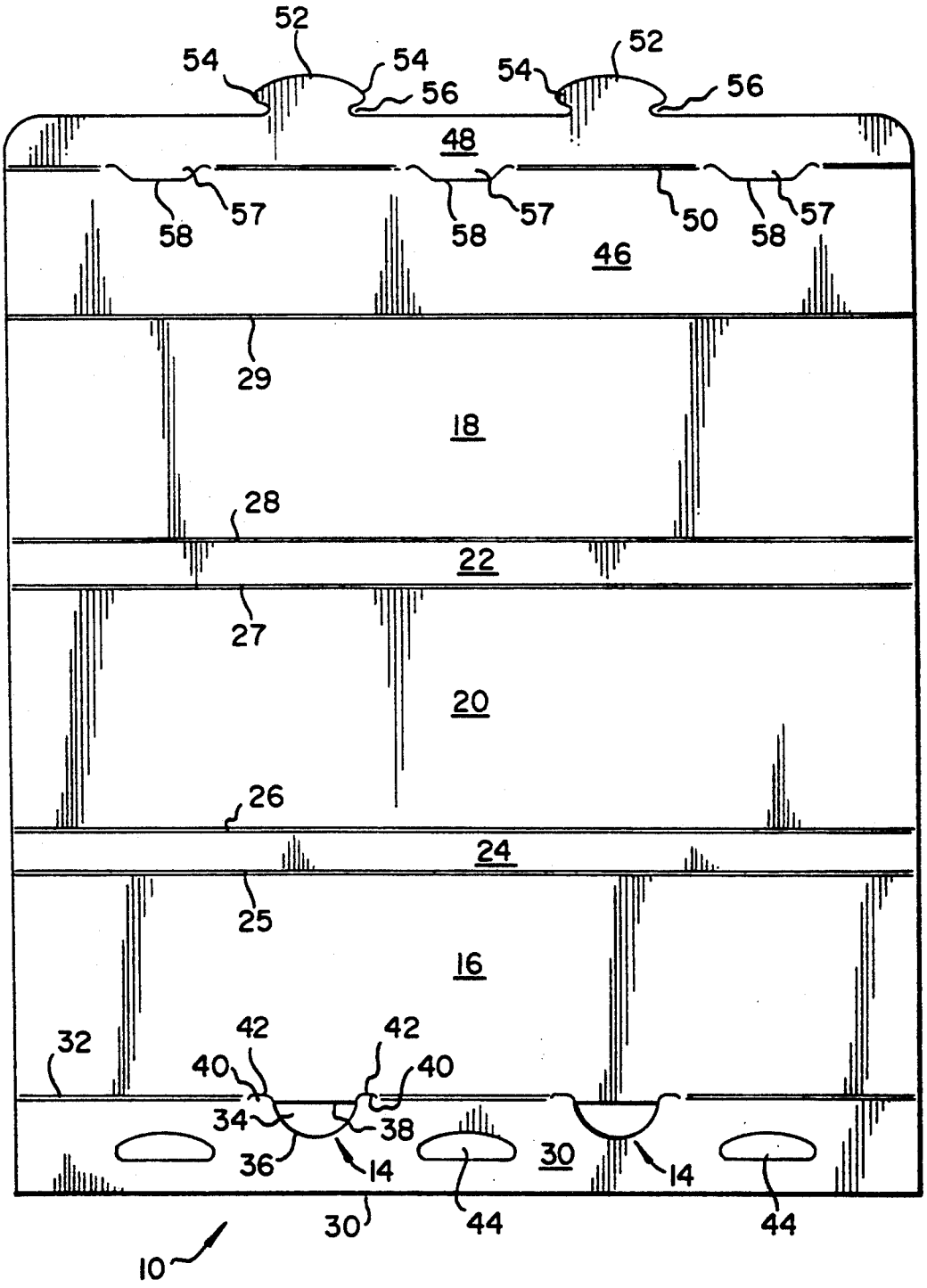
FIG. 1 is a top plan view of a carton blank and illustrates a preferred form of secondary lock means and a conventional form of primary lock means.

Referring to the drawings, the carton blank generally indicated by the numeral 10 in FIG. 1, and the carton 12 formed from the blank 10 and illustrated in FIGS. 2–5, inclusive, relate to a first embodiment of the invention and, more particularly, to a female locking member, generally indicated by the numeral 14 in FIGS. 1 and 5.

Blank 10 includes side panels 16 and 18, a top panel 20, and, as shown, a pair of expander panels 22 and 24 which may be used to extend either the side panels or the top panel, but which form no part of the present invention. The various panels are delineated by a series of creases or fold lines 25–29, inclusive, as is best shown in FIG. 1.

Blank 10 also contains an inner closure panel 30, which is connected to panel 16 along a transversely extending fold line 32, and in which are formed a pair of female locking members 14 located along the fold line 32 and each having a cutout portion 34 forming a substantially large opening defined by a generally arcuate boundary 36 having the ends thereof joined by a rectilinear chord 38. A pair of tab members 40, 40 are carried by inner closure panel 30 and form locking ear means extending generally tangential to cutout portion 34 at opposite ends of chord 38 and the locking ears are defined by generally "C"-shaped cutlines 42 in panel 16 along fold line 32. Cutout portion 34 is shown as being generally semi-circular which is the presently preferred form but some variations thereof are possible without substantially lessening the size of cutout portion 34.

Inner closure panel 30 also is provided with a series of cutouts or openings 44 centrally disposed within panel 30 and being spaced transversely from each other for forming the female portion of a primary lock arrangement.

Blank 10, at the end thereof opposite from inner closure panel 30, includes an outer closure panel 46 having as part thereof a panel portion 48 attached along a transversely extending fold line 52 and having carried by and attached thereto a pair of male locking members 52. Locking members 52 are generally shaped in the form of an arrowhead and have oppositely extending nose portions 54 which are spaced from panel portion 48 to form slots 56 so that nose portions 54 are held in place by tab members 40 when locking members 52 are inserted through cutout portions 34 upon erection of carton 12.

Outer closure panel 46 is provided along fold line 50 with a series of male locking tabs 57 defined by cut lines 58 and which, in a known manner, are inserted into openings 44 in inner closure panel 30 for completing primary lock means for holding carton 12, and beverage cans or other food packages and the like, in assembled form.

FIGS. 4 and 5 are particularly useful in showing the secondary lock means of the present invention wherein the female locking member 14 provides a large opening or cutout portion 34 for receiving locking member 52 when inner closure panel 30 is bent relative to panel 16 along fold line 32 and the locking member 52 is guided into the opening formed by cutout 34 by engagement with the under side of panel 16.

In the above descriptions of the preferred embodiment of the invention, it is to be understood that descriptive terminology, such as top and side panel members, has been used for illustrative purposes and is not intended to be a limitation since it is well known that cartons of the present general type may be placed in various orientations without detracting from or limiting the invention.

Further, while the instant invention has been shown and described herein in what is believed to be the best mode and preferred embodiment, it is recognized that departures may be made therefrom within the scope of the invention as set out in the following claimed subject matter.

I claim:

1. A locking arrangement for a carton having overlapping closure panels including an inner closure panel and an outer closure panel, a male locking member carried by and attached to said outer closure panel, said inner closure panel being connected to a second along a generally transversely extending fold line, a female locking member located along said fold line and including a cutout portion for receiving said male locking member, said cutout portion being located substantially within the confines of said inner closure panel primarily on one side of said fold line and having a generally arcuate boundary having ends thereof joined by a rectilinear chord extending therebetween, locking ear means located along said fold line adjacent said chord and said cutout portion for being engaged by said male locking member for retaining said male locking member within said cutout portion, said locking ear means comprising a pair of tab members carried by said inner panel adjacent to said cutout portion, and said tab member being cut from said second panel along curved cut lines and extending from said inner closure panel across said fold line.

2. A locking arrangement as defined in claim 1 wherein said cutout portion is generally semi-circular and provides a substantially large opening for receiving said male locking member therein.

* * * * *